US005279404A

United States Patent [19]

Bruner et al.

[11] Patent Number: 5,279,404

[45] Date of Patent: Jan. 18, 1994

[54] COIN COUNTING AND ESCROW SYSTEM

[75] Inventors: Philemon L. Bruner; David C. Bugge, both of Houston, Tex.

[73] Assignee: Imonex Services Inc., Katy, Tex.

[21] Appl. No.: 790,777

[22] Filed: Nov. 12, 1991

Related U.S. Application Data

[63] Continuation of Ser. No. 537,575, Jun. 14, 1990, abandoned, which is a continuation-in-part of Ser. No. 291,523, Dec. 29, 1988, abandoned.

[51] Int. Cl.[5] ..... G07F 1/04

[52] U.S. Cl. ..... 194/346

[58] Field of Search ..... 194/344, 346, 350, 219, 194/220, 221, 222, 223, 230, 231, 239, 244, 245, 246

[56] References Cited

U.S. PATENT DOCUMENTS

| | | | |
|---|---|---|---|
| 1,932,234 | 10/1933 | Sengebusch | 194/245 |
| 2,323,657 | 7/1943 | Henning | 194/244 |
| 4,165,802 | 8/1979 | Mathews | 194/344 |
| 4,550,818 | 11/1985 | Holliday | 194/346 |

OTHER PUBLICATIONS

"Imonex Unveils Expanded Escrow Kit for Cigarette Vender 'ACMR' Mechs," Vending Times, vol. 29, No. 3 (Mar. 1989).

"Imonex 'Contin-U-Op 520' Boosts Reliability in Wide Range of Mechanical Pricing Devices," Vending Times (Nov. 1987).

Imonex Advertising Sheet for "The Contin-U-Op," Upgrade Your ACMR's and Enlarged Escrow (Sep. 1990).

*Primary Examiner*—F. J. Bartuska

*Attorney, Agent, or Firm*—Arnold, White & Durkee

[57] ABSTRACT

A coin escrow unit including a first and a second body where the first body has a first and second flange, where the first flange is adapted to impart a tumbling movement to downwardly moving coins, and the second flange is downwardly distending, and where the second body has a downwardly distending flange, the downwardly distending flanges of the first and second bodies combining with two gates to form the coin escrow.

53 Claims, 4 Drawing Sheets

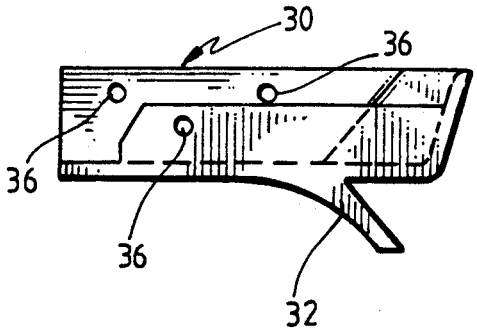
FIG.4
FIG.5
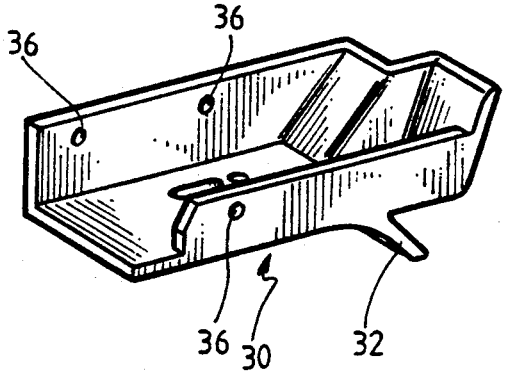
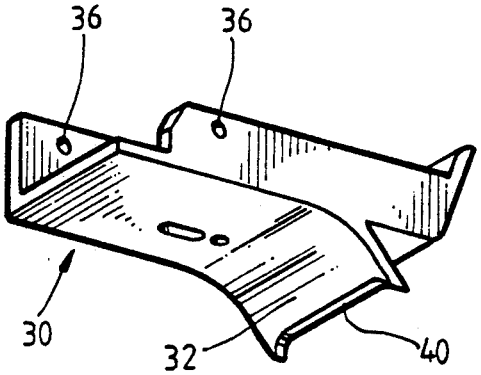
FIG.6
FIG.10
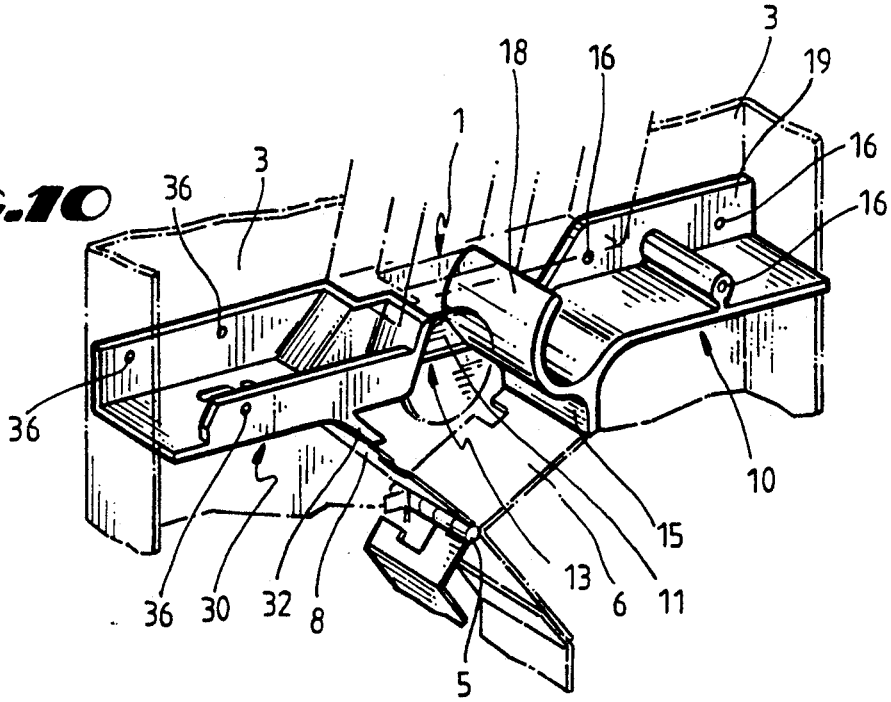

COIN COUNTING AND ESCROW SYSTEM

CROSS REFERENCE TO RELATED APPLICATIONS

This application is a continuing application from applicant's co-pending application Ser. No. 537,575, filed 6/14/90 now abandoned which is a continuation-in-part of applicant's application Ser. No. 291,523, filed 12/29/88 now abandoned. The disclosures of the parent and grandparent applications are hereby incorporated by reference.

BACKGROUND OF THE INVENTION

1. Field of the Invention

The present invention relates to an improved coin registration and collection system for use in a coin activated machine. More specifically, the present invention is directed to an improved coin counting and escrow system designed to reduce the frequency of coins lodging or jamming in the coin counting and escrow system, thereby blocking the passage of any coins subsequently introduced into the machine and rendering the machine inoperative. In addition, the present invention is directed to an improved escrow unit which reduces the incidence of theft.

2. Description of the Prior Art

Coin activated machines, such as vending machines, usually include a coin registration and collection system comprising a coin separating mechanism, a coin counting mechanism or totalizer, such as an All Coin Manual Recorder ("ACMR"), and an escrow unit for accumulating the coins thus counted. The particular structure of these mechanisms may vary depending on the function of the particular coin activated machine. However, when the machine is in an upright, operating position, generally these mechanisms are organized in a vertical array whereby the coin counting mechanism, such as an ACMR, is positioned below the coin separating mechanism and above the escrow unit. In such a fashion, coins introduced into the coin activated machine fall by gravity first through the coin separating mechanism. Next the coins fall through the coin counting mechanism or ACMR. As the coins exit the coin counting mechanism, they are collected in the escrow unit.

Coins often lodge or jam in one or more of the mechanisms comprising the coin registration and collection system of a coin activated machine. Coins often jam as a result of the passage of bent, damaged or oversized coins. However, more modern coin separating mechanisms route such coins directly to the coin return, preventing their passage through the rest of the coin registration and collection system. Such a mechanism is disclosed in applicant's U.S. Pat. No. 4,911,280.

Prior art coin counting mechanisms are susceptible to coins becoming jammed in the coin race. This is often caused by the parallel planar accumulation of two or more coins in the coin passage of the unit itself. When coin blockage of this type occurs, the machine must be serviced by a trained service technician. The technician must open the vending machine to release or remove the jammed coins. Often to free the coin blockage, he must disassemble the coin counting mechanism. This coin blockage generally occurs as a result of coins stacking one on another in a vertical disposition in the escrow unit. Put another way, the coins stack vertically in on-edge orientation. Thus, after several coins stack in the escrow unit in this on-edge orientation, any coins subsequently introduced into the machine will "back up" into the coin counting mechanism.

Prior art escrow units have a number of other problems associated with them. In conventional escrow units, the escrow unit includes a pair of gates or levers. When the escrow vend gate is activated, it releases the accumulated coins to a cash box in the machine. The escrow return gate, when it is activated, releases the accumulated coins to the coin return slot of the machine. When the gates are both in a first, closed or "collection" position, they each fit flush against a downwardly-extending retaining stud. After the coin registration and collection system has registered an adequate deposit of coins, the purchaser may operate a vend button or knob on the machine. The desired product or service is then delivered to the purchaser and the gate opening to the cash box moves to a second, open position, releasing the accumulated coins from the escrow unit into the cash box. The purchaser may have a change of heart, however, and decide not to purchase any products or services. The purchaser then operates a coin return button or knob on the machine. The gate opening to the coin return slot moves to a second, open position, releasing the accumulated coins from the escrow unit into the coin return slot.

Because the gates are designed to fit flush against the stud, coins exiting the escrow unit may be caught or trapped between the stud and the gate as the gate is returning to the closed or collection position. Thus, the gate is stuck in a partially open position. In conventional escrow units, the coin can be caught or trapped in a vertical orientation between the escrow return gate and the stud. Any coins subsequently deposited into the machine are still registered by the coin counting mechanism. However, with the escrow return gate stuck in this open position, most if not all of these subsequently deposited coins will fall into the escrow unit and continue through the open gate to the coin return slot. Thus, unrestricted and unlimited vending is possible. Thieves have learned how to intentionally get coins caught in this manner, so the thieves can receive the products or services from the machine for free.

In prior art coin counting and escrow systems, a coin exits the coin counting mechanism, or ACMR, in an on-edge orientation, such that the coin's faces are essentially parallel to the coin's travel path through the coin counting mechanism. The coin will often remain in this on-edge orientation as it comes to rest in the escrow unit. Subsequent coins exiting the coin counting mechanism tend to stack edge-to-edge, one atop the other in this on-edge orientation. When a large number of coins is required for a particular product or service, the coins will back up through the coin counting mechanism as noted above, rendering the coin activated machine inoperative.

The inoperability of coin activated machines, such as vending machines, can be doubly expensive. First, there are the costs associated with remedying the problem, which generally include the charge for a service call by a trained technician. Then there are the costs associated with the lost vending opportunities. A frequently used vending machine may necessitate one or more service calls per day, resulting in an expense of many hundreds of dollars per week. As might be expected, such expenses greatly reduce the profitability and desirability of such a vending machine.

SUMMARY OF THE INVENTION

The present invention addresses the above noted and other problems associated with prior art coin registration and collection systems. The invention provides an improved coin counting and escrow system which greatly reduces the likelihood of coins jamming in or backing up into the coin counting mechanism. The invention further provides an improved escrow vend gate and an improved escrow return gate which greatly reduce the probability that a coin will be caught or trapped in a vertical orientation between either gate and its corresponding stud.

The coin counting mechanism or totalizer of the present invention generally comprises a body in which has been formed a vertically disposed coin race or chute. A coin deposited into the machine drops through the coin separating mechanism, exiting from the coin separating mechanism into the top of the race. The coin continues downwardly through the race to the bottom of the race and exits from the race into the escrow unit. The coin race is provided with a narrowed constriction which prevents the movement or passage of more than one coin through the constriction at a time. Below the constriction, the coin pathway enlarges in a reverse, funnel-like fashion, which allows the coin to depart from the vertical or on-edge orientation.

In a preferred form of the invention, each coin is forced to adopt a dynamic, tumbling orientation after it has exited the coin counting mechanism, resulting in a greatly reduced likelihood that the coin will come to rest in an on-edge, or vertical, orientation. Instead, each coin will tend to come to rest in a flat, "face down" orientation: that is, when the coin comes to rest, the faces of the coin will tend to lie in a plane substantially perpendicular to the coin's travel path through the coin counting mechanism, or ACMR. In such a fashion, coins collecting in the escrow will not tend to stack one atop the other in an "on end" orientation. Since coins take up significantly less vertical space in the escrow unit in this flat, "face down" orientation, many more coins can be accumulated in the escrow unit without the problem of coins backing up into the coin counting, or ACMR, mechanism.

In a preferred form, the escrow unit of the present invention preferably reduces the likelihood that a coin will be caught or trapped in a vertical orientation between either of the escrow gates and its corresponding stud, thereby stopping or significantly reducing unrestricted and unlimited vending.

The escrow unit includes two separate, yet integral, structures. The first structure, hereinafter referred to as a coin deflecting assembly, comprises an attachment bracket provided with a special adaptation or flange extending into the reservoir of the escrow unit. The flange is preferably adapted to extend across the drop path of coins exiting the coin counting mechanism.

The flange itself preferably comprises a bevelled or angled shank and a flattened extremity. The bevelled shank is bevelled in two parts, an upper portion of increasing thickness and a lower portion of decreasing thickness, as viewed in the direction of the coin drop path. As a coin exits the coin counting mechanism, it contacts the upper bevelled portion of the flange. This contact with the shank causes the coin to adopt a dynamic, tumbling or rotating orientation as it continues to fall into the escrow unit.

As noted, the flange preferably also comprises a flattened extremity. The purpose of the flattened extremity is to reduce the likelihood of a coin accumulated in the escrow unit becoming jammed between the flange and the escrow return gate when the purchaser operates the coin return button or knob. Similarly, the purpose of the bevelled lower edge of the shank is to reduce the likelihood of a coin accumulated in the escrow unit becoming jammed between the flange and the escrow vend gate when the purchaser operates a vend button or knob.

The coin deflecting assembly is preferably further provided with a second, depending flange extending downwardly for contacting the escrow vend gate. This second flange is provided in a preferred form with a tapered, arcuate contact surface. The purpose of the tapered, arcuate contact surface is to reduce the likelihood that a coin will be caught or trapped in a vertical orientation between the escrow vend gate and the downwardly-extending flange.

The second structure of the escrow unit, hereinafter referred to as a retention bracket, comprises a body adapted to be positioned below the coin counting, or ACMR, mechanism. This body forms, in association with the escrow gates and the first structure of the escrow unit, a reservoir in which coins accumulate or collect prior to completion of the vending operation. The body of this second structure is preferably provided with a depending flange extending downwardly for contacting the escrow return gate. This depending flange is provided in a preferred form with a tapered, arcuate contact surface. The purpose of the tapered, arcuate contact surface is to reduce the likelihood that a coin will be caught or trapped in a vertical orientation between the escrow return gate and the downwardly-extending flange.

The present invention offers a number of advantages over the prior art. One such advantage is the reduced frequency of coins becoming jammed in the coin counting mechanism, or ACMR. A second advantage is the ability of the present invention to reduce the tendency of coins collecting in an on-edge or vertical orientation in the escrow unit. This is accomplished by the combination of the coin counting mechanism and the escrow unit. Thus, malfunctions of the machine due to coins stacking on-edge in the escrow unit and backing up into the coin counting mechanism infrequently occur, if ever. Yet another advantage of the present invention is its ability to reduce the incidence of theft and unit malfunction caused by a coin getting caught between an escrow gate and one of the downwardly-extending flanges of the escrow unit. Thus, theft due to unrestricted and unlimited vending may be significantly curtailed.

Other objects, features and advantages of the present invention will become apparent to those of skill in the art upon a consideration of the following detailed description and the accompanying drawings.

BRIEF DESCRIPTION OF THE DRAWINGS

FIG. 4 is a side view of the coin retention bracket of the escrow unit.

FIG. 5 is a top perspective view of the coin retention bracket of the escrow unit.

FIG. 6 is a bottom perspective view of the coin retention bracket of the escrow unit.

FIG. 10 is a top perspective view of the escrow unit, including the coin deflecting assembly and the coin retention bracket.

DETAILED DESCRIPTION OF THE PREFERRED EMBODIMENTS

The following detailed description illustrates the coin counting and escrow system of the present invention. When like elements are described in two or more different figures, like numbers have been used to identify those elements.

Figure 1:
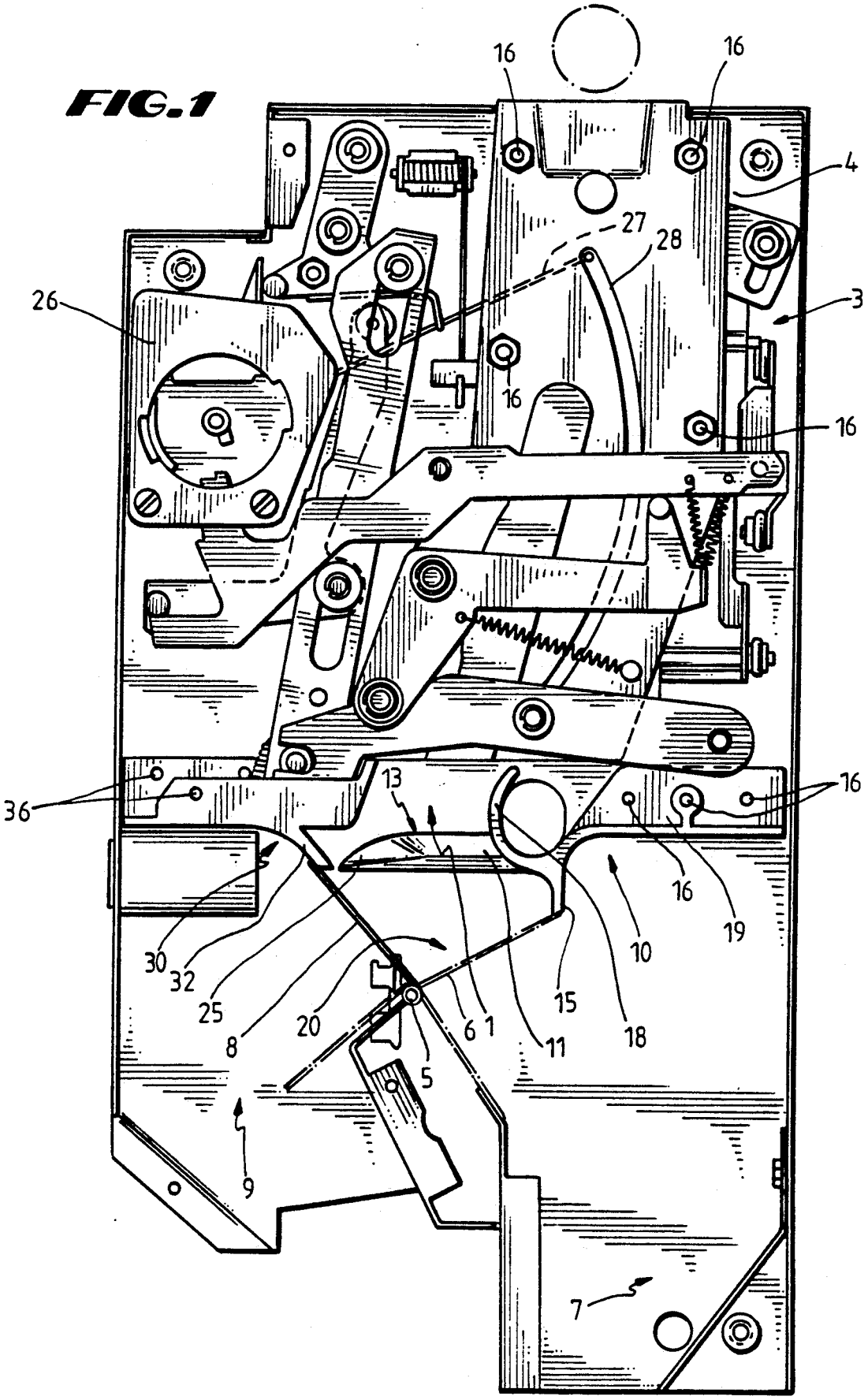
FIG. 1 is a frontal view of a coin registration and collection system in which is disposed the coin counting and escrow system of the present invention.

A conventional coin activated machine, such as a vending machine, generally utilizes a series of separate mechanisms to separate, count and collect the coins inserted in the machine prior to completion of the vending operation. The mechanisms used to count and collect coins prior to the vending operation are shown in FIG. 1, which generally illustrates the improved coin counting and escrow system of the present invention. The coin counting and escrow system generally comprises the coin counting mechanism 4 and the escrow unit 20. Escrow unit 20 generally comprises the coin deflecting assembly 10 and the coin retention bracket 30, which are positioned below coin counting mechanism 4, such as an All Coin Manual Recorder ("ACMR"). The components illustrated in FIG. 1 but not labeled or described are of a design familiar to those skilled in the art and do not comprise a portion of the claimed invention.

The coin counting mechanism 4 and the escrow unit 20 are operably mounted on housing attachment plate 3 or the like via conventional fasteners inserted through apertures 16, as illustrated in FIG. 1 In an ordinary operating condition, housing attachment plate 3 is mateable with a faceplate. The faceplate is not shown in order to more clearly illustrate the coin counting and escrow system. When they are so mated, the housing attachment plate and faceplate form a substantially closed unit.

In a preferred form, coin counting mechanism or totalizer 4, such as an ACMR, generally includes two elongate plates 21, 22. By referring to FIG. 2, it can be seen that elongate plate 21 is positioned nearer the housing attachment plate 3 and defines a longitudinally disposed groove 23 on the side of elongate plate 21 which faces toward elongate plate 22 and away from housing attachment plate 3. Elongate plates 21, 22 are adapted to be joined together with a nut and bolt, or other conventional fastener. A bolt is inserted through housing attachment plate 3, apertures 16 in elongate plates 21, 22 and fastener plate 24. A nut is then screwed onto the extended portion of the bolt.

The side of elongate plate 21 having groove 23 is joined together with and abuts elongate plate 22 to form a coin race or chute between the plates. When elongate plates 21, 22 and fastener plate 24 are fastened to housing attachment plate 3, coin counter arm 27, which can pivot about the coin counter 26, extends into the coin race through arcuate slots 28A, 28B as will be further described herein. It is envisioned that counter 26 is of a generally conventional design and operation familiar to those skilled in the art.

Figure 2:
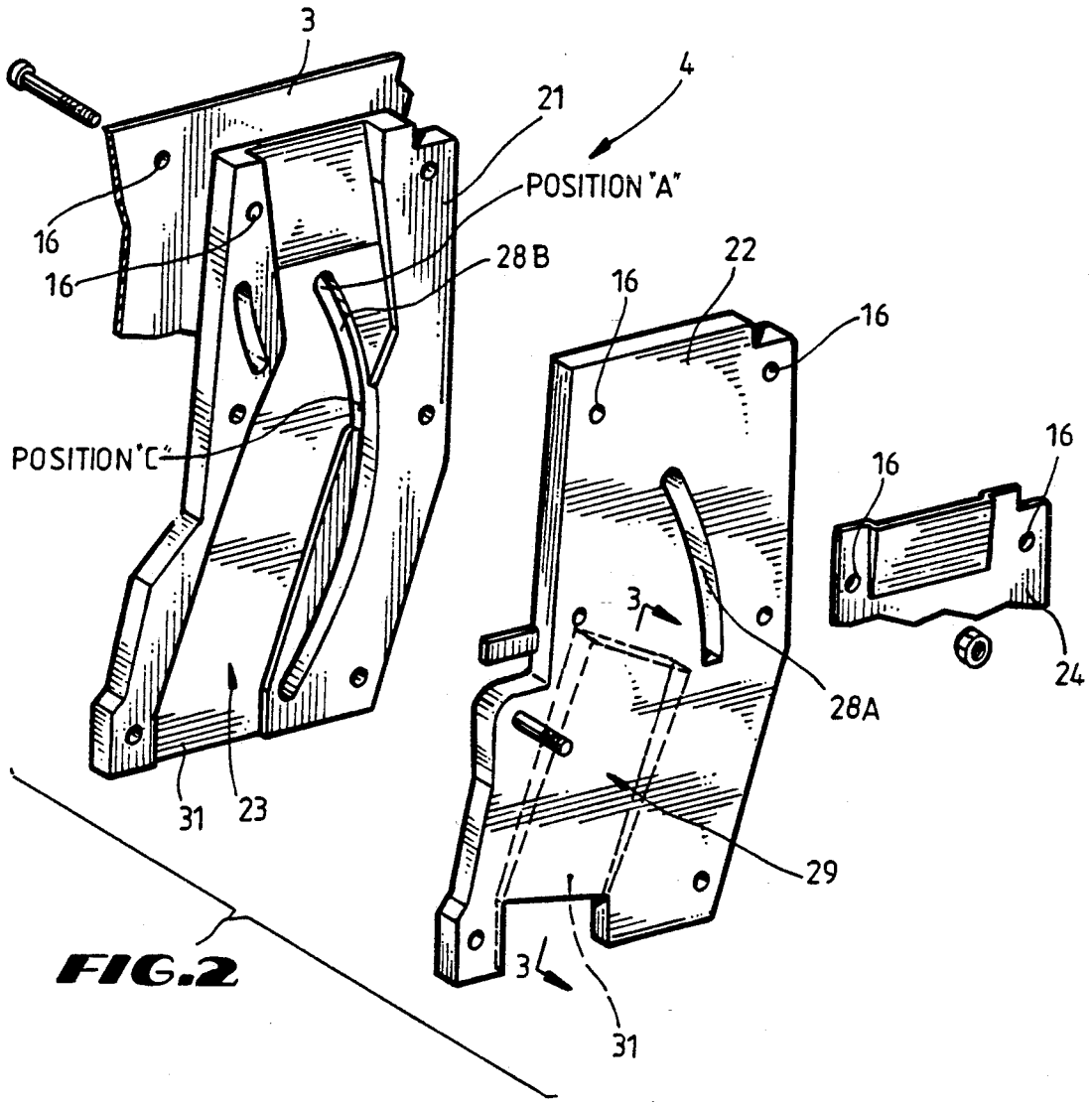
FIG. 2 is a perspective, exploded view of the coin counting mechanism of the present invention.

Referring to FIG. 1 and FIG. 2, coin counter arm 27 is attached to coin counter 26 for pivotal movement about the coin counter. Arcuate slots 28A, 28B are provided in elongate plates 21, 22 of the coin counting, or ACMR, mechanism 4 so as to accommodate this pivoting movement of coin counter arm 27. Coin counter arm 27 extends laterally through arcuate slot 28A, the coin race or chute defined by groove 23 and arcuate slot 28B. When coin counter arm 27 pivots about the coin counter 26, the distal end of coin counter arm 27 moves along the arc defined by arcuate slots 28A, 28B.

The arc defined by arcuate slots 28A, 28B extends outside the coin race or chute defined by groove 23. In a preferred form, coin counting arm 27 extends through slot 28A and at least partly into slot 28B. The distal end of coin counting arm 27 is urged by biasing means, such as a spring or the like, to a first position A, as shown in FIG. 2. Coin counting arm 27 is pivotable about the joint with coin counter 26, such that the distal end of coin counter 27 moves from first position A (where the distal end extends through the race) to a second position C (where the distal end no longer extends through the race).

The operation of the coin counter mechanism 4 may be best described as follows: as a coin falls down the race defined by groove 23, the coin impacts the distal end of coin counting arm 27, which extends through the race at position A, as illustrated in FIG. 2. As the coin continues to fall, it pushes the distal end downward until the distal end is pushed out of the race, as best illustrated by position C in FIG. 2. The coin continues to fall past position c. The distal end of coin counter arm 27 now returns to position A due to the biasing means.

Each time coin counter arm 27 moves from position A to position C and returns back to A, it trips or actuates coin counter 26. Thus, coin counter 26 can mechanically record or "count" the coins as they are inserted into the machine. After a sufficient number of coins have been recorded by coin counter 26, the purchaser may operate a vend button or knob on the machine. The desired product or service is then delivered to the purchaser and the accumulated coins are released into the cash box 7, as will be further described hereinafter. Alternatively, the purchaser may have a change of heart and decide not to purchase any products or services. The purchaser will then operate a coin return button or knob on the machine and the accumulated coins are released into the coin return slot or area 9, as will be further described. When the purchaser operates either a vend button or the coin return button, the coin counter 26 will automatically reset to zero.

In the prior art, coin counters are formed with a groove defining a coin race of a substantially uniform thickness along the length of the race. Coins fall through the counter and are released into the escrow in a vertical, or on-edge, orientation. Often the coins will stack one atop the other in the escrow in this on-edge orientation. When coin activated machines were introduced a number of years ago, this did not prove to be a problem because then the price for a given product was significantly less than the price for the same product today.

Because of the increased costs of vended products and services today, vending operations now typically require the introduction of a large number of coins. If the coins stack in an on-edge orientation, each coin subsequently introduced into the machine stacks at a higher point in the escrow until the stack of coins backs up into the coin counter. Since the coin race of a prior art counter is of a substantially uniform thickness, coins subsequently introduced into the machine will tend to accumulate in the coin race in a parallel planar fashion, with the face of one coin abutting the face of the other. When the purchaser operates either a vend button or the coin return button, the escrow is emptied as will be further described hereinafter. However, coins collected in a parallel planar fashion often are unable to move downwardly and remain jammed in the coin race of the coin counter, rendering the machine inoperative until the jammed coins are freed or removed.

The preferred form of the present invention reduces the incidence of coin jams due to the parallel planar collection of coins in the coin counter. Groove 23 provides a coin race of substantially uniform thickness through the upper portion of the coin counting mechanism 4. Of course, the coin race defined by groove 23 must be thicker than the thickest coin to be accepted by the machine. However, the upper portion of the coin race is preferably thinner or slimmer than twice the thickness of the thinnest coin to be accepted by the machine.

In one embodiment of the present invention which is designed for use in the United States, the coin race in the upper portion of the counter is roughly one and a quarter times the thickness of a U.S. quarter. Thus, while a U.S. quarter can easily pass through the upper portion of the race, two dimes cannot pass through the upper portion in a parallel planar orientation. Of course, the thickness of this upper portion of the coin race can be varied to accommodate whatever type of coinage is to be accepted by the machine. Thus, only one coin of any denomination can pass through the upper portion of the coin race at any given time. Since only one coin is allowed to pass through the upper portion of the totalizer 4 at any given time, coins cannot lodge in a parallel planar fashion.

Figure 3:
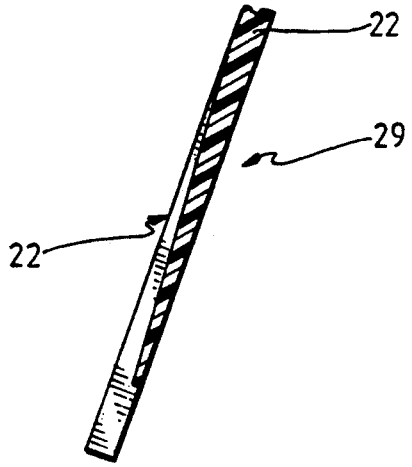
FIG. 3 is a side, cross sectional view of the lower section of the coin counting mechanism as drawn along lines A—A.

Referring to FIG. 2 and FIG. 3, the lower portion of elongated plate 22 has a declining width in area 29 of plate 22 corresponding to groove 23 in the lower portion of elongated plate 21. Thus, when elongated plate 21 abuts against elongated plated 22, the coin race has a linearly increasing thickness or width, starting at the uniform thickness of the coin race in the upper portion. The bottom or exit 31 of the coin race, defined by the lower portions of the plates 21, 22, has a thickness or width preferably equal to approximately 1.2 times the thickness of the coin race of the upper portion. Thus, in a machine for use in the United States, the bottom or exit 31 of the coin race is roughly one and a half times the thickness of a U.S. quarter.

Preferably, the area 29 of the decreasing width of plate 22 begins immediately below position C as identified in FIG. 2. The coin race, as defined by groove 23 in plate 21 and the decreasing width of plate 22 in area 29, has a maximum thickness at its bottom or exit 31. The width of the exit 31 preferably is less than the thickness of two of the thinnest coins to be accepted by the machine. Thus, only one coin can pass through the lower portion of the coin counting mechanism 4 at any given time. This significantly reduces the incidence of coin blockage or jamming caused by the parallel planar collection of coins in the race.

A coin passing through the coin race of a conventional coin counter travels downwardly in a vertical or on-edge orientation, such that the face of the coin is substantially parallel to the housing attachment plate as the coin falls. The coin maintains this substantially vertical orientation through the length of the coin counter. Thus, when the coin exits the counter into the escrow, the coin often comes to rest in the escrow in this same vertical, on-edge orientation. A coin subsequently deposited into the machine will often stack on the previously deposited coins in this on-edge orientation. However, it is undesirable for coins to stack in this orientation since, after the deposit of only a few coins, the stack is backed up into the coin counter, as above described. Many more coins can accumulate in the same escrow if the coins are orientated in a substantially flat or "face down" orientation.

In a preferred form of the present invention, coins passing through the coin counting mechanism 4 are not constrained to move in an on-edge orientation due to the reverse, funnel-like structure of the coin race. Due to this structure, coins generally begin to depart from the vertical on-edge orientation upon moving past the constriction corresponding to position C in FIG. 2. In such a fashion, coins tend to accumulate in escrow unit 20 in the desirable "face down" orientation.

Referring to FIG. 1 and FIG. 2, coin counting mechanism 4 generally comprises a series of parallel plates stacked one atop the other. Plate 21 has a space formed about its length which allows a coin to travel through the coin counting, or ACMR, mechanism 4 in a plane generally parallel to housing attachment plate 3 of the coin counting and escrow system; in other words, elongated plates 21, 22 allow a coin to travel therebetween in a generally vertically disposed orientation. Thus, coins travel in a vertically disposed, or on-edge, orientation through coin counting mechanism 4.

After each coin has activated coin counter 26, as has been already described, the coin passes out of coin counting, or ACMR mechanism 4 into a coin drop area, generally defined as 1 in FIG. 1 and FIG. 10. Often, the coin Will continue falling in a vertical, or on-edge orientation. The coin falls through coin drop area 1 and comes to rest in escrow unit 20, which is generally defined by escrow vend gate 6 and escrow return gate 8. Gates 6 and s pivot about axis 5 in response to buttons or knobs, or other suitable mechanisms operated by the purchaser. In the embodiment illustrated in FIG. 1, escrow return gate 8 routes coins to the coin return slot or area 9; escrow vend gate 6 routes the coins to the cash box 7.

In many cases, coins collecting in escrow unit 20 collect in the fashion in which they traveled through the coin counting mechanism 4; e.g., the coins stack one atop the other in an on-edge orientation. The lateral width of a conventional escrow unit 20, however, is generally insufficient to allow for a substantial accumulation of coins in escrow unit 20 when the coins accumulate vertically one atop the other. Therefore, after the collection of three, four or more coins, coins subsequently deposited into the machine will "back up" through coin counting, or ACMR, mechanism 4. This often results in the inoperability of the machine.

Figure 7:
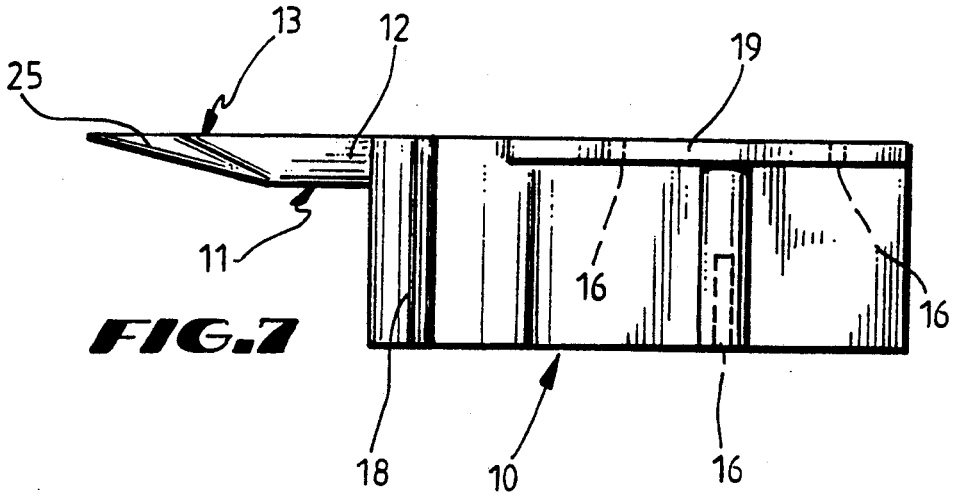
FIG. 7 is a top view of the coin deflecting assembly of the escrow unit.
Figure 8:
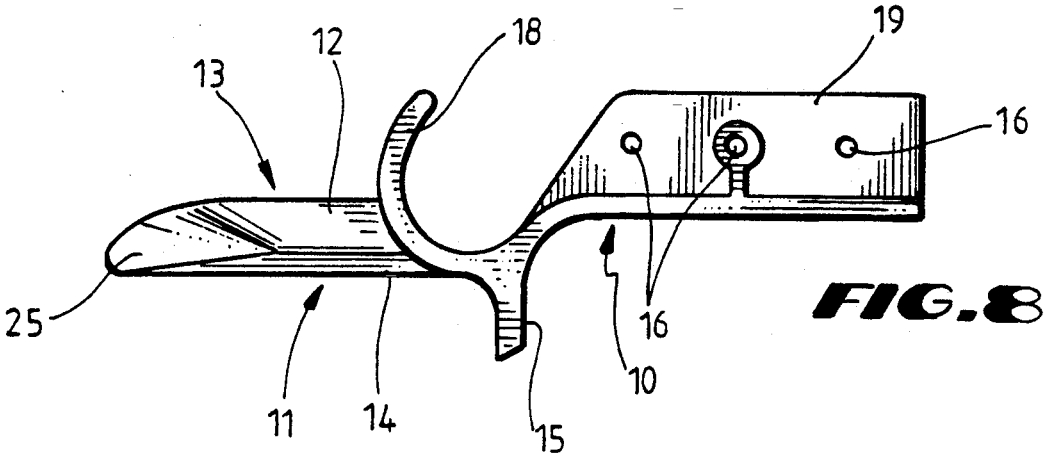
FIG. 8 is a side view of the coin deflecting assembly of the escrow unit.
Figure 9:
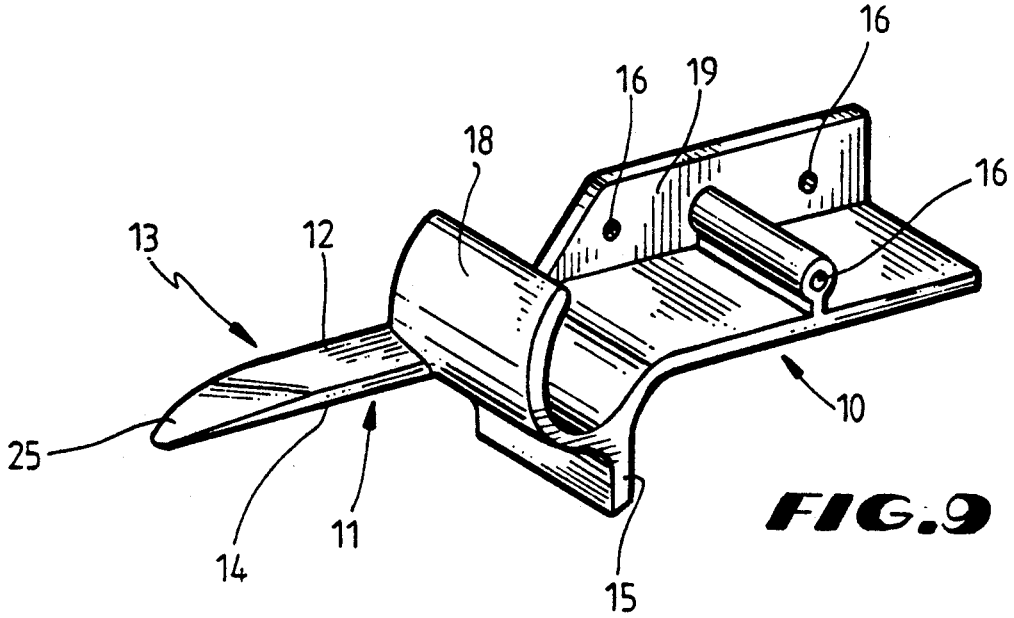
FIG. 9 is a top perspective view of the coin deflecting assembly of the escrow unit.

As shown in FIG. 1 and FIG. 10, this undesirable phenomenon is addressed in the present invention by the combination of a coin deflecting assembly 10 and a retention bracket 30. Referring to FIG. 7 through FIG. 9, coin deflection assembly 10 is generally comprised of an attachment bracket 19 having an extended flange 13. In a preferred form, a depending flange 15 may be provided to more completely enclose escrow unit 20.

Attachment bracket 19 is generally adapted to be secured to housing attachment plate 3 via conventional fasteners inserted through apertures 16. In a preferred embodiment, a curved extension 18 may be formed in the coin deflecting assembly 10 so as to facilitate connection of attachment bracket 19 to housing attachment plate 3. When attachment bracket 19 is secured to housing attachment plate 3, extended flange 13 extends across the coin's drop path so as to intercept the flow of coins exiting from coin counting mechanism 4.

Preferably, extended flange 13 comprises a bevelled shank 11 terminating in a flattened extremity 25. The upper portion 12 of bevelled shank 11, which is the portion above the vertical midpoint of bevelled shank 11, is thinnest at its uppermost edge. The thickness of upper portion 12 increases along the coin drop path to the lowermost location of upper portion 12, where upper portion 12 is thickest. This lowermost location of upper portion 12 is at the vertical midpoint of bevelled shank 11. The lower portion 14 of bevelled shank 11, which is the portion below the vertical midpoint of bevelled shank 11, is thickest at its uppermost location, that is, at the vertical midpoint of bevelled shank 11. The thickness of lower portion 14 decreases along the coin drop path to the lowermost edge of lower portion 14, where lower portion 14 is thinnest. Thus, bevelled shank 11 is preferably thickest at its vertical midpoint.

It will be understood that bevelled shank 11 is bevelled in two parts, an upper portion 12 of increasing thickness and a lower portion 14 of decreasing thickness, as viewed in the direction of the coin drop path. A bevelled shank having an upper and lower portion of equal lengths has been described here by way of example. It should be understood that the upper and lower portions need not be of equal lengths. As a coin exits the coin counting mechanism, it contacts the upper portion 12 of bevelled shank 11. Due to this contact with bevelled shank 11, the coin adopts a dynamic, tumbling or rotating orientation as the coin continues to fall into the escrow unit.

The purpose of bevelled shank 11 is to cause coins exiting from coin counting mechanism 4 to depart from movement in a vertically disposed orientation and to adopt a tumbling path preparatory to contacting escrow vend gate 6 and escrow return gate 8. In this connection, it is desirable that the coins descending to escrow gates 6 and 8 will adopt a nonvertical orientation and accumulate in a horizontal position. In such a fashion more coins may be accumulated in escrow unit 20.

Critical to the operation of the coin deflecting assembly 10, bevelled shank 11 must extend out at least as far into coin drop area 1 so as to contact substantially all coins exiting from the coin counting mechanism regardless of their diameter, thickness or travel speed relative to housing attachment plate 3. In this connection, the upper portion of bevelled shank 11 induces the coins to adopt a tumbling path as they pass from coin drop area 1 into escrow unit 20.

As noted, extended flange 13 preferably also comprises a flattened extremity 25. The purpose of flattened extremity 25 is to reduce the incidence of machine malfunction during a vending operation. Flattened extremity 25 of extended flange 13 functions to reduce the likelihood of a coin accumulated in escrow unit 30 becoming jammed between extended flange 13 and escrow return gate 8 when the purchaser operates the coin return button or knob. Similarly, the reason for bevelling lower portion 14 of bevelled shank 11 is to reduce the likelihood of a coin accumulated in escrow unit 30 becoming jammed between extended flange 13 and escrow vend gate 6 when the purchaser operates a vend button or knob.

A detailed understanding of retention bracket 30 may be obtained by reference to FIG. 4 through FIG. 6. Retention bracket 30 generally comprises a body adapted to be attached to housing attachment plate 3 via conventional fasteners inserted through apertures 36. As noted, retention bracket 30 is adapted to be positioned beneath the coin counting, or ACMR, mechanism 4 so as to form, in association with escrow gates 6 and 8, escrow unit 20 in which the coins collect prior to their ultimate disposition. Bracket 30 is preferably provided with a downwardly extending flange 32 which is in contact with escrow return gate 8 when escrow return gate 8 is in a first "collection" position, as illustrated in FIG. 1 and FIG. 10. In preferred embodiments, downwardly extending flange 32 is provided with a tapered, arcuate contact surface 40. The contact surface is tapered and arcuate in order that substantially all coins caught between escrow return gate 8 and downwardly extending flange 32 are forced to assume an orientation generally perpendicular to the plane defined by housing attachment plate 3. In such a fashion, theft or vandalism of products contained in the machine can be diminished.

The operation of the combination coin deflecting assembly 10 and retention bracket 30 may be described as follows: Coins inserted into a vending machine for a desired product move through a coin separating and rejecting assembly (which is not shown in order to more clearly illustrate the coin counting and escrow system) and then pass into the coin counting mechanism 4 whereupon the coins adopt a vertically disposed, or on-edge, orientation in a plane generally parallel to housing attachment plate 3. In the coin counting or ACMR mechanism 4, the number and denomination of the coins is registered. Subsequent to this procedure, coins exit the coin counting mechanism 4 and pass generally through coin drop area 1 as controlled by the exit surfaces of the coin counting mechanism 4. Upon exiting the coin counting mechanism 4, some coins remain in a generally on-edge orientation.

The downwardly travelling coins then contact the bevelled shank 11 of extended flange 13, where the bevelled shank 11 causes the coins to adopt a tumbling orientation. In such a fashion, coins entering the escrow unit 20 collect in a generally horizontally disposed or flat orientation on escrow return gate 8 or escrow vend gate 6, or both.

After a sufficient passage of coins through the coin counting mechanism 4, the purchaser operates a button, knob or the like. Either escrow vend gate 6 or escrow return gate 8 swing from a first, closed or "collection" position, as shown in FIG. 1, to a second, open position, as shown in phantom in FIG. 1. Each of the escrow gates 6, 8 is biased to its respective first, closed or "collection" position by an expandable tension spring or similar biasing element. The expandable tension springs are not shown in order to more clearly illustrate the gates 6, 8. Either escrow vend gate 6 or escrow return gate s swings from the first, closed position to the second, open position, allowing coins collected thereupon to pass downwardly in the machine. Upon release of the coins, escrow vend gate 6 or escrow return gate 8 then resumes the first, closed or "collection" position as illustrated in FIG. 1.

The description of the present invention has been presented for purposes of illustration and description, but is not intended to be exhaustive or limit the invention in the precise form disclosed. For example, although the coin deflecting assembly of the present invention is provided with extended flange 13, an obvious modification would be to eliminate extended flange 13 and to form housing attachment plate 3 with an inclined ramp or ridge at a similar location, the ramp or ridge traversing the downward coin travel path. Similarly, another modification would be to exchange or reverse the locations of coin return slot or area 9 and cash box 7. Obviously, many other modifications and variations will be apparent to practitioners skilled in this art. A particular embodiment was chosen and described in order to best teach and explain the principles of the invention and its practical application to enable others skilled in the art to understand the invention for various uses and with various modifications as are suited to the particular use contemplated.

What is claimed is:

1. A coin activated machine for providing goods or services in exchange for a deposit of a combination of coins, each of said coins having two opposed faces, said machine including a coin registration and collection system, said coins following a downward coin travel path due to the forces of gravity, said coin registration and collection system comprising:

(a) a housing;

(b) a coin separating mechanism attached to said housing;

(c) a coin counting mechanism attached to said housing at a location below said coin separating mechanism when said machine is in an upright, operating position, wherein said coins exit said coin counting mechanism in an on-edge orientation such that said opposed faces of said coins are substantially vertical;

(d) an escrow unit attached to said housing at a location below said coin counting mechanism when said machine is in said upright, operating position, said escrow unit comprising, (1) means for deflecting said coins from said on-edge orientation to a dynamic, tumbling orientation, at least part of said means for deflecting said coins extending into said coin travel path, (2) means for accumulating said coins, said means for accumulating being located below said means for deflecting said coins, said means for accumulating comprising a first gate.

2. The coin activated machine of claim 1 wherein said means for deflecting said coins comprises a first flange extending into said coin travel path.

3. The coin activated machine of claim 2 wherein said first flange is provided with a bevelled upper portion.

4. The coin activated machine of claim 3 wherein said first flange is further provided with a bevelled lower portion.

5. The coin activated machine of claim 4 wherein said first flange is further provided with a tapered, flattened extremity.

6. The coin activated machine of claim 2 wherein said means for accumulating said coins further comprises a second flange, said second flange having an end adapted to fit cooperatively with said first gate.

7. The coin activated machine of claim 6 wherein said end has a bevelled contacting edge.

8. The coin activated machine of claim 7 wherein said bevelled contacting edge is arcuate in shape.

9. The coin activated machine of claim 6 wherein said means for accumulating further comprises a second gate.

10. The coin activated machine of claim 9 wherein said means for accumulating said coins further comprises a third flange, said third flange being adapted to fit cooperatively with said second gate.

11. A coin registration and collection system for registering and collecting a deposit of a combination of coins into a coin activated machine, each of said coins having two opposed faces, said coins following a downward coin travel path due to the forces of gravity, said coin registration and collection system comprising:

(a) a housing;

(b) a coin separating mechanism attached to said housing;

(c) a coin counting mechanism attached to said housing at a location below said coin separating mechanism when said machine is in an upright, operating position, wherein said coins exit said coin counting mechanism in an on-edge orientation such that said opposed faces of said coins are substantially vertical;

(d) an escrow unit attached to said housing at a location below said coin counting mechanism when said machine is in said upright, operating position, said escrow unit comprising, (1) means for deflecting said coins from said on-edge orientation to a dynamic, tumbling orientation, at least part of said means for deflecting said coins extending into said coin travel path, (2) means for accumulating said coins, said means for accumulating being located below said means for deflecting said coins, said means for accumulating comprising a first gate.

12. The coin registration and collection system of claim 11 wherein said means for deflecting said coins comprises a first flange extending into said coin travel path.

13. The coin registration and collection system of claim 12 wherein said first flange is provided with a bevelled upper portion.

14. The coin registration and collection system of claim 13 wherein said first flange is further provided with a bevelled lower portion.

15. The coin registration and collection system of claim 14 wherein said first flange is further provided with a tapered, flattened extremity.

16. The coin registration and collection system of claim 12 wherein said means for accumulating said coins further comprises a second flange, said second flange having an end adapted to fit cooperatively with said first gate.

17. The coin registration and collection system of claim 16 wherein said end has a bevelled contacting edge.

18. The coin registration and collection system of claim 17 wherein said bevelled contacting edge is arcuate in shape.

19. The coin registration and collection system of claim 16 wherein said means for accumulating further comprises a second gate.

20. The coin registration and collection system of claim 19 wherein said means for accumulating said coins further comprises a third flange, said third flange being adapted to fit cooperatively with said second gate.

21. A coin escrow unit for use in a coin registration and collection system for registering and collecting a deposit of a combination of coins into a coin activated machine, each of said coins having two opposed faces, said coin registration and collection system comprising a housing, a coin separating mechanism attached to said housing, a coin counting mechanism attached to said housing at a location below said coin separating mechanism when said machine is in an upright, operating position, said escrow unit being attached to said housing at a location below said coin counting mechanism when said machine is in said upright, operating position, said coins following a downward coin travel path due to the forces of gravity and exiting said coin counting mechanism in an on-edge orientation such that said opposed faces of said coins are substantially vertical, said escrow unit comprising:

(a) means for deflecting said coins from said on-edge orientation to a dynamic, tumbling orientation, at least part of said means for deflecting said coins extending into said coin travel path, (b) means for accumulating said coins, said means for accumulating being located below said means for deflecting said coins, said means for accumulating comprising a first gate.

22. The coin escrow unit of claim 21 wherein said means for deflecting said coins comprises a first flange extending into said coin travel path.

23. The coin escrow unit of claim 22 wherein said first flange is provided with a bevelled upper portion.

24. The coin escrow unit of claim 23 wherein said first flange is further provided with a bevelled lower portion.

25. The coin escrow unit of claim 24 wherein said first flange is further provided with a tapered, flattened extremity.

26. The coin escrow unit of claim 22 wherein said means for accumulating said coins further comprises a second flange, said second flange having an end adapted to fit cooperatively with said first gate.

27. The coin escrow unit of claim 26 wherein said end has a bevelled contacting edge.

28. The coin escrow unit of claim 27 wherein said bevelled contacting edge is arcuate in shape.

29. The coin escrow unit of claim 26 wherein said means for accumulating further comprises a second gate.

30. The coin escrow unit of claim 29 wherein said means for accumulating said coins further comprises a third flange, said third flange being adapted to fit cooperatively with said second gate.

31. A coin activated machine for providing goods or services in exchange for a deposit of a combination of coins into a coin activated machine, each of said coins having two opposed faces, said machine including a coin registration and collection system, said coins following a downward coin travel path due to the forces of gravity, said coin registration and collection system comprising:

a housing;

(b) a coin separating mechanism attached to said housing;

(c) a coin counting mechanism attached to said housing at a location below said coin separating mechanism when said machine is in an upright, operating position;

(d) an escrow unit attached to said housing at a location below said coin counting mechanism when said machine is in said upright, operating position, said escrow unit including, means for accumulating said coins, said means for accumulating including a first gate, said means for accumulating said coins further including a body, said body including a flange, said flange terminating in a flange terminus adapted to fit cooperatively with said first gate, wherein said flange terminus has a bevelled contacting edge.

32. A coin activated machine for providing goods or services in exchange for a deposit of a combination of coins into a coin activated machine, each of said coins having two opposed faces, said machine including a coin registration and collection system, said coins following a downward coin travel path due to the forces of gravity, said coin registration and collection system comprising:

a housing;

(b) a coin separating mechanism attached to said housing;

(c) a coin counting mechanism attached to said housing at a location below said coin separating mechanism when said machine is in an upright, operating position;

(d) an escrow unit attached to said housing at a location below said coin counting mechanism when said machine is in said upright, operating position, said escrow unit including, means for accumulating said coins, said means for accumulating including a first gate, sand means for accumulating said coins further including a body, said body including a flange, said flange terminating in a flange terminus adapted to fit cooperatively with said first gate, wherein said flange terminus has a bevelled contacting edge, and wherein said bevelled contacting edge is arcuate in shape.

33. A coin escrow unit for use in a coin registration and collection system for registering and collecting a deposit of a combination of coins into a coin activated machine, each of said coins having two opposed faces, said coin registration and collection system comprising a housing, a coin separating mechanism attached to said housing, a coin counting mechanism attached to said housing at a location below said coin separating mechanism when said machine is in an upright, operating position, said escrow unit being attached to said housing at a location below said coin counting mechanism when said machine is in said upright, operating position, said coins following a downward coin travel path due to the forces of gravity and exiting said coin counting mechanism in a first orientation such that said opposed faces of said coins are substantially vertical, said escrow unit comprising:

(a) a first bracket, said first bracket having a first flange extending into said coin travel path, said flange causing said coins to deviate from said first orientation, (b) a first gate, said first gate being located below said first bracket.

34. The coin escrow unit of claim 33 wherein said first flange is provided with a bevelled upper portion.

35. The coin escrow unit of claim 34 wherein said first flange is further provided with a bevelled lower portion.

36. The coin escrow unit of claim 35 wherein said first flange is further provided with a tapered, flattened extremity.

37. The coin escrow unit of claim 33 wherein said means for accumulating said coins further comprises a second flange, said second flange having an end adapted to fit cooperatively with said first gate.

38. The coin escrow unit of claim 37 wherein said end has a bevelled contacting edge.

39. The coin escrow unit of claim 38 wherein said bevelled contacting edge is arcuate in shape.

40. The coin escrow unit of claim 37 wherein said means for accumulating further comprises a second gate.

41. The coin escrow unit of claim 40 wherein said means for accumulating said coins further comprises a third flange, said third flange being adapted to fit cooperatively with said second gate.

42. In a coin activated machine for providing goods or services in exchange for a deposit of a combination of coins, each of said coins having two opposed faces, said machine being provided with an escrow unit for accumulating said coins, said coins following a downward coin travel path due to the forces of gravity and said coins having an on-edge orientation such that said opposed faces are substantially vertical when said coins are released into said escrow unit, a method for preventing said coins from stacking on each other in said on-edge orientation, said method comprising contacting said coins with a member as said coins follow said downward coin travel path before said coins come to rest in said escrow unit, said contacting thereby causing said coins to deviate from said on-edge orientation.

43. In a coin activated machine for providing goods or services in exchange for a deposit of a combination of coins, each of said coins having two opposed faces, said machine being provided with an escrow unit for accumulating said coins, said coins following a downward coin travel path due to the forces of gravity and said coins having an on-edge orientation such that said opposed faces are substantially vertical when said coins are released into said escrow unit, a method for preventing said coins from stacking on each other in said on-edge orientation, said method comprising placing an obstruction through said downward coin travel path, said obstruction coming into contact with said coins as they follow said downward coin travel path before said coins come to rest in said escrow unit, said obstruction thereby causing said coins to deviate from said on-edge orientation.

44. In a coin activated machine for providing goods or services in exchange for a deposit of a combination of coins, each of said coins having two opposed faces, said machine being provided with an escrow unit for accumulating said coins, said coins following a downward coin travel path due to the forces of gravity and said coins having an on-edge orientation such that said opposed faces are substantially vertical when said coins are released into said escrow unit, a method for preventing said coins from stacking on each other in said on-edge orientation, said method comprising imparting a tumbling, dynamic orientation to said coins after said coins are released into said escrow unit and before said coins come to rest in said escrow unit.

45. A coin deflection and collection system for used in a coin escrow of a coin actuated machine, where said escrow is situation below means to carry coins in a substantially on-edge orientation where the movement of said coins from said carrying means to said escrow defines a substantially linear coin travel path, comprising:

(a) a first body defining a first and second flange, where said first flange extends into said coin travel path so as to impart a tumbling motion to said coins prior to said coins collecting in said escrow, said second flange distending downwardly so as to engage a first gate in said escrow such that the combination second flange and gate forms a portion of a coin retention means;

(b) a second body having a downwardly distending flange adapted to engage a second gate in said escrow such that the combination of the flange of the second body and the second gate form the remaining portion of the coin retention means.

46. The coin deflection and collection system of claim 45 wherein the first flange of the first body is provided with a beveled upper and lower surface.

47. The coin deflection and collection system of claim 45 wherein the first flange of the first body is provided with a tapered, flattened tip.

48. The coin deflection and collection system of claim 45 wherein the second flange of the first body is provided with a beveled contacting edge.

49. The coin deflection and collection system of claim 45 wherein the flange of the second body includes an accurate beveled contracting edge.

50. A coin deflection and collection system for use in conjunction with a coin escrow in a coin actuated machine, where coins utilized in said coin actuated machine drop through said system and are collected in said escrow, comprising:

(a) a first member defining a transverse contact arm which extends into the coin drop path and a lower extending extremity, where said contact arm is adapted to engage and alter the drop path of coins passing through said system and impart a tumbling orientation thereto and said lower extending extremity is adapted to engage a first gate in the escrow when said gate is in a closed position to form a portion of a coin retaining means; and (b) a separate, second member defining a downwardly extending extremity which is adapted to engage a second gate in the escrow when said second gate is in a closed position to form the remaining portion of the coin retaining means.

51. The coin deflection and collection system of claim 50 wherein said transverse arm of said first member is provided with upper and lower laterally beveled surfaces.

52. The coin deflection and collection system of claim 50 wherein the lower extremity of the first member is beveled.

53. The coin deflection and collection system of claim 50 wherein the downwardly extending extremity of a second member is arcuate in configuration.

* * * * *

UNITED STATES PATENT AND TRADEMARK OFFICE

CERTIFICATE OF CORRECTION

PATENT NO. : 5,279,404

DATED : January 18, 1994

INVENTOR(S) : Philemon L. Bruner; David C. Bugge

It is certified that error appears in the above-identified patent and that said Letters Patent is hereby corrected as shown below:

In column 8, line 51, after "6 and", please delete "s" and in its place insert --8--.

In column 11, line 3, after "gate", please delete "s" and in its place insert --8--.

Signed and Sealed this

Thirty-first Day of May, 1994

Bruce Lehman

*Attest:*

BRUCE LEHMAN

*Attesting Officer*

*Commissioner of Patents and Trademarks*